US005623848A

United States Patent [19]

Kirii

[11] Patent Number: 5,623,848

[45] Date of Patent: Apr. 29, 1997

[54] PRESSING METHOD AND SYSTEM WHEREIN CUSHION PLATEN IS LOWERED BY COOPERATION OF SHOCK ABSORBERS AND CYLINDERS BEFORE HOLDING OF BLANK BETWEEN DIE AND PRESSURE RING

[75] Inventor: Kazunari Kirii, Aichi-ken, Japan

[73] Assignee: Toyota Jidosha Kabushiki Kaisha, Japan

[21] Appl. No.: 648,373

[22] Filed: May 15, 1996

[30] Foreign Application Priority Data

May 22, 1995 [JP] Japan ..... 7-122088

[51] Int. Cl.[6] ..... B21D 24/14

[52] U.S. Cl. ..... 72/351; 72/453.13; 267/119

[58] Field of Search ..... 72/350, 351, 453.13; 267/119

[56] References Cited

U.S. PATENT DOCUMENTS

| | | | |
|---|---|---|---|
| 4,635,466 | 1/1987 | Seki et al. | 72/453.13 |
| 5,003,807 | 4/1991 | Terrell et al. | 72/351 |

FOREIGN PATENT DOCUMENTS

| | | |
|---|---|---|
| 0417753 | 3/1991 | European Pat. Off. . |
| 0417754 | 3/1991 | European Pat. Off. . |
| 3610109 | 5/1987 | Germany . |
| 60-89933 | 6/1985 | Japan . |
| 5-57362 | 3/1993 | Japan . |
| 5-69050 | 3/1993 | Japan . |
| 6-190465 | 7/1994 | Japan . |
| 6-312225 | 11/1994 | Japan . |
| 6-304800 | 11/1994 | Japan . |

OTHER PUBLICATIONS

Patent Abstract of Japan, vol. 17, No. 365 (M-1442) 9 Jul. 1993 (attached to JP 5-57362).

*Primary Examiner*—Lowell A. Larson

*Attorney, Agent, or Firm*—Finnegan, Henderson, Farabow, Garrett & Dunner, L.L.P.

[57] ABSTRACT

Pressing method and system wherein a drawing operation on blank is performed by die and punch while the blank is held between the die and a pressure ring by a blank holding force which is generated based on a movement resistance of the cushion platen and which is transmitted to the pressure ring through first cylinders and cushion pins, and wherein during a downward movement of the die toward the pressure ring, the cushion platen is moved down against the movement resistance before holding of the blank between the die and the pressure ring, by cooperation of second cylinders disposed on the cushion platen and communicating with the first cylinders, and shock absorbers disposed between the second cylinders and the die or a member moving with the die, so that the speed at which the die collides with the pressure ring is reduced by the downward movement of the pressure ring with the cushion platen.

10 Claims, 4 Drawing Sheets

PRESSING METHOD AND SYSTEM WHEREIN CUSHION PLATEN IS LOWERED BY COOPERATION OF SHOCK ABSORBERS AND CYLINDERS BEFORE HOLDING OF BLANK BETWEEN DIE AND PRESSURE RING

BACKGROUND OF THE INVENTION

1. Field of the Invention

The present invention relates in general to a pressing method and a pressing system, and more particularly to techniques for reducing a shock or impact upon collision of a die with a blank on a pressure ring, by using shock absorbers.

2. Discussion of the Related Art

There is widely used a pressing system including (a) a die and a punch cooperating to perform a drawing operation on a blank to draw the blank along a forming surface of the punch, (b) a cushion platen, (c) resistance applying means for applying a resistance to a movement of the cushion platen, (d) a pressure ring cooperating with the die to hold the blank at a peripheral portion thereof during the drawing operation, and (e) a plurality of cushion pins interposed in parallel with each other between the cushion platen and the pressure ring, for transmitting a blank holding force based on the above-indicated resistance to the pressure ring, wherein the drawing operation is performed when the pressure ring and the die are moved relative to the punch in a pressing direction against the above-indicated resistance. During the drawing operation, the cushion platen is lowered against the resistance applied thereto by the resistance applying means, while the cushion platen has a substantially horizontal attitude. The punch is fixedly positioned on a bolster disposed above the cushion platen. The cushion pins are supported at their lower ends by the cushion platen such that the cushion pins extend through respective through-holes formed through the bolster and respective through-holes formed through the punch. The cushion pins support at their upper ends the pressure ring. The die disposed above the punch and pressure ring is reciprocated in the vertical direction by suitable drive means, so that the die and the pressure ring are moved relative to the punch so as to perform the drawing operation on the blank.

Also known is a pressing system further including (f) a plurality of fluid-actuated balancing cylinders which are disposed on the cushion platen such that the lower ends of the cushion pins are associated with the pistons of the respective fluid-actuated balancing cylinders- The fluid-actuated balancing cylinders are hydraulic cylinders having respective pressure chambers communicating with each other, and the pistons of these cylinders are held in their neutral positions during the drawing operation with the blank held by and between the pressure ring and the die, so that the blank holding force acts evenly or uniformly on the pressure ring through all of the cushion pins. An example of this type of pressing system is disclosed in JP-A-6-304800 (published in 1994). In this pressing system, the blank holding force is evenly distributed to the pressure ring and the blank through the fluid in the hydraulic cylinders and the cushion pins, so as to establish a desired distribution of the blank holding force depending upon the arrangement of the cushion pins, irrespective of dimensional and positional errors or variations such as a length variation of the cushion pins and an inclination of the cushion platen with respect to the horizontal plane.

The drawing operation on the blank is initiated with a collision of the die with the blank and the pressure ring. This collision may cause a considerable noise and/or an oscillatory change of the blank holding force, which may lead to defective products formed by the drawing operation. In view of this drawback, there has been proposed to use a shock absorber device for reducing the shock or impact upon collision of the die with the blank and the pressure ring. An example of the shock absorber device is disclosed in JP-U-60-89933 (published in 1985), wherein shock absorbers are interposed between the cushion platen and the resistance applying means in the form of a pneumatic cylinder for applying a resistance to movement of the cushion platen.

In the conventional pressing system provided with the shock absorber device described above, however, the reaction forces of the shock absorbers act on local portions of the cushion platen, and may cause deflection or bending deformation of the cushion platen, resulting in a risk of uneven distribution of the blank holding force. Even in the presence of the shock absorbers, the blank holding force still undesirably oscillates or fluctuates in an initial period of the drawing operation immediately after the collision of the die with the blank and the pressure ring, due to a reaction force produced by the collision, which reaction force causes operating instability of the various mechanical components of the pressing system such as unstable elimination of backlash of a gear train in the drive means for reciprocating the die. Thus, the provision of the shock absorbers in the conventional pressing system is not effective enough to overcome the drawback.

SUMMARY OF THE INVENTION

It is therefore an object of the present invention to reduce the amount of deflection or deformation of the cushion platen and the amount of oscillation of the blank holding force immediately after the collision of the die with the blank and the pressure ring, in a pressing system which is provided with a shock absorber device for reducing the shock upon the collision.

The above object may be achieved according to a first aspect of this invention, which provides a method of performing a drawing operation on a blank in a pressing system including (a) a die and a punch cooperating to perform the drawing operation to draw the blank along a forming surface of the punch, (b) a cushion platen, (c) resistance applying means for applying a resistance to a movement of the cushion platen, (d) a pressure ring cooperating with the die to hold the blank at a peripheral portion thereof during the drawing operation, (e) a plurality of first cylinders disposed on the cushion platen and having respective pressure chambers and respective pistons, and (f) a plurality of cushion pins interposed between the first cylinders and the pressure ring, for transmitting a blank holding force based on the resistance to the pressure ring, wherein the drawing operation is performed during movements of the pressure ring and the die relative to the punch in a pressing direction against the resistance, such that the pistons of the first cylinders are held at neutral positions between upper and lower stroke ends thereof, for even distribution of the blank holding force to the pressure ring through all of the cushion pins, the method comprising the steps of: (i) providing the cushion platen with a plurality of second cylinders which have respective pressure chambers communicating with the pressure chambers of the first cylinders; (ii) providing a plurality of shock absorbers between the second cylinders respectively and one of the die and a member moving with the die; and (iii) moving down the cushion platen against the resistance, by cooperation of the second cylinders and the shock absorbers during a downward movement of the die toward the pressure ring and before holding of the blank by the blank holding force by and between the die and the pressure ring, for thereby reducing a speed at which the die collides with the pressure ring through the blank.

In the pressing method of the present invention, the shock absorbers and the second cylinders are operated during the downward movement of the die toward the pressure ring and before the blank is held between the die and the pressure ring, so that a reaction force generated by the shock absorbers causes the cushion platen to be moved down against the resistance applied thereto by the resistance applying means, whereby the pressure ring is accordingly moved down. As a result, the speed at which the die subsequently collides with the pressure ring through the blank is reduced. In other words, the difference between the speeds of the die and the pressure ring at the moment of collision of the die with the pressure ring is reduced. This arrangement is effective to reduce the shock generated when the die collides with the pressure ring, and is therefore effective to reduce the collision noise and the deterioration of the blank holding performance of the pressure ring due to the collision shock.

In the present pressing method, the reaction force of the shock absorbers acts on the cushion platen through the second cylinders whose pressure chambers communicate with the pressure chambers of the first cylinders, whereby the fluid in the pressure chambers of the second cylinders are pressurized and the fluid is discharged from the second cylinders into the second cylinders. Accordingly, the shock generated upon operation of the shock absorbers (upon abutting contact of the piston rods of the shock absorbers with the piston rods of the second cylinders) is reduced to thereby reduce the amount of deflection or bending deformation of the cushion platen. Further, the pistons of the first cylinders disposed on the cushion platen are placed in their neutral positions, so that the blank holding force is evenly distributed from the cushion platen to the pressure ring through all of the first cylinders. Thus, the present method assures the desired distribution of the blank holding force to the pressure ring through the first cylinders.

Further, the operation of the shock absorbers eliminates mechanical plays of the components of the press prior to the collision of the die with the pressure ring via the blank, whereby the blank holding force does not have an undesired oscillatory variation even during an initial portion of the drawing operation. This elimination of the mechanical plays and the reduction of the relative speed of the die and the pressure ring upon their collision provide a synergistic effect to assure suitable holding of the blank without the oscillatory variation even in the initial portion of the drawing operation which is initiated with the collision of the die with the pressure ring.

For holding the cushion platen in a predetermined attitude, it is desirable to provide three or more sets of shock absorbers and second cylinders. Where the cushion platen is provided with a multiplicity of fluid-actuated cylinders for dealing with various kinds of blanks, selected ones of these fluid-actuated cylinders are used as the first cylinders or balancing cylinders for even distribution of the blank holding force. In this case, selected ones of the fluid-actuated cylinders other than those used as the first cylinders are used as the second cylinders, and the shock absorbers are provided corresponding to the second cylinders, for example, attached to the die such that the second cylinders are aligned with the second cylinders. Therefore, the conventional pressure wherein the cushion platen is provided with multiple fluid-actuated cylinders may be easily and economically retrofitted into the present pressing system, by simply providing the shock absorbers, without a considerable structural modification.

The object indicated above may also be achieved according to a second aspect of this invention, which provides a pressing system including (a) a die and a punch cooperating to perform a drawing operation on a blank to draw the blank along a forming surface of the punch, (b) a cushion platen, (c) resistance applying means for applying a resistance to a movement of the cushion platen, (d) a pressure ring cooperating with the die to hold the blank at a peripheral portion thereof during the drawing operation, (e) a plurality of first cylinders disposed on the cushion platen and having respective pressure chambers and respective pistons, and (f) a plurality of cushion pins interposed between the first cylinders and the pressure ring, for transmitting a blank holding force based on the resistance to the pressure ring, wherein the drawing operation is performed during movements of the pressure ring and the die relative to the punch in a pressing direction against the resistance, such that the pistons of the first cylinders are held at neutral positions between upper and lower stroke ends thereof, for even distribution of the blank holding force to the pressure ring through all of the cushion pins, the pressing system comprising: (i) a plurality of second cylinders disposed on a cushion platen and having respective pressure chambers communicating with the pressure chambers of the first cylinders; and (ii) a plurality of shock absorbers disposed between the second cylinders respectively and one of the die and a member moving the die. The second cylinders and the shock absorbers cooperate to move down the cushion platen against the resistance during a downward movement of the die toward the pressure ring and before holding of the blank by and between the die and the pressure ring, for thereby reducing a speed at which the die collides with the pressure ring through the blank.

The present pressing system is constructed to suitably practice the method of the invention described above. Namely, the second cylinders are disposed on the cushion platen and communicate with the first cylinders, and the shock absorbers are disposed between the second cylinders and the die or a suitable member moving with the die. During the downward movement of the die toward the pressure ring, the shock absorbers and the second cylinders are simultaneous operated before the blank is held between the die and the pressure ring, so that the cushion platen is moved down against the resistance applied thereto by the resistance applying means, whereby the pressure ring is accordingly moved down. As a result, the speed at which the die subsequently collides with the pressure ring through the blank is reduced. Thus, the present pressing system provides substantially the same advantages as the pressing method of the invention described above.

According to one preferred form of the pressing system of this invention, each of the first and second cylinders has a piston, and each of the shock absorbers includes a piston rod which is moved with the piston of the corresponding second cylinder during simultaneous operations of the shock absorber and the corresponding second cylinder. Further, each shock absorber has a resistance to movement of its piston rod, which resistance is determined to hold the piston of the corresponding second cylinder at a substantially lower stroke end thereof at least for a period immediately after the pistons of said first cylinders have been moved to neutral positions thereof.

In the above preferred form of the pressing system, the pistons of the second cylinders are held at their lower stroke ends at least when the pistons of the first cylinders have been moved to their neutral positions after collision of the die with the pressure ring. This arrangement is effective to restrict the upward movement of the cushion platen toward the die and is therefore prevent undesirable oscillatory movements of the cushion platen immediately after the collision of the die with the pressure ring. Accordingly, the present arrangement is effective to restrict the oscillatory variation of the blank holding force acting on the pressure ring which is supported by the cushion platen through the first cylinders and cushion pins. Accordingly, the pressing system assures improved blank holding performance of the pressure ring and enhanced quality of the products manufactured by the drawing operation.

According to a second preferred form of the pressing system, each of the first and second cylinders has a piston, and each of the shock absorbers includes a piston rod which is moved with the piston of the corresponding second cylinder during simultaneous operations of the shock absorber and the corresponding second cylinder, as in the above preferred form of the pressing system. In the present second preferred form, each shock absorber has a resistance to movement of its piston rod, which resistance is determined to permit the piston of the corresponding second cylinder to move toward the pressure ring during the drawing operation while the blank is held by and between the die and the pressure ring.

In the second preferred form of the pressing system, the pistons of the second cylinders are permitted to move upwards toward the pressure ring during the drawing operation. The upward movement of the pistons of the second cylinders causes an increase in the volume of the pressure chambers of the second cylinders and consequent reduction of the pressure of the fluid in the second cylinders, whereby the blank holding force to be transmitted to the pressure ring through the first cylinders is reduced. The pressure in the first and second cylinders when their pistons are all placed in their neutral positions is determined by the resistance to the movement of the cushion platen applied by the resistance applying means. Consequently, an increase in the volume of the pressure chambers of the second cylinders causes an eventual decrease in the volume of the pressure chambers of the first cylinders, so that the pressure is substantially held at a constant level corresponding to the movement resistance of the cushion platen. However, a delayed volume decrease of the first cylinders with respect to the volume increase of the second cylinders will cause temporary expansion of the fluid and consequent drop of the fluid pressure, resulting in temporary decrease of the blank holding force. The amount of decrease of the blank holding force varies depending upon the rate and amount of change of the volume of the first and second cylinders. Hence, the blank holding force can be reduced as needed during the drawing operation, if the movement resistance or operating characteristic of the shock absorbers is suitably determined by adjusting the size of orifices formed through the pistons of the shock absorbers and/or the viscosity of the fluid in the shock absorbers. This arrangement is effective to prevent a risk of cracking or rupture of the blank and to assure improved quality of the products to be manufactured by the drawing operation, or permit the use of a lower-quality material as the blank.

According to a further preferred form of the pressing system, each of the shock absorbers includes a cylindrical housing, and a piston which is received in the cylindrical housing and which has at least one orifice formed therethrough. The cylindrical housing and the piston define two fluid chambers which are filled with a fluid such as an oil (e.g., silicone oil) and which are formed on opposite sides of the piston, and the two fluid chambers communicate with each other through the at least one orifice. The at least one orifice provides a predetermined resistance to flows of there fluid therethrough, thereby providing a resistance to movement of the piston relative to said cylindrical housing.

According to a still further preferred form of the pressing system, the second cylinders have respective piston rods, and the shock absorbers are attached to the die and have respective piston rods which are brought into abutting contact with the piston rods of the corresponding second cylinders during the downward movement of the die toward the pressure ring and before the blank is held by and between the die and the pressure ring.

Alternatively, the shock absorbers are disposed such that the piston rods of the shock absorbers are associated with the piston rods of the second cylinders, so that the die or a member moving with the die is brought into abutting contact with the piston rods of the shock absorbers during the downward movement of the die and before the blank is held by and between the die and the pressure ring.

BRIEF DESCRIPTION OF THE DRAWINGS

The above and optional objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
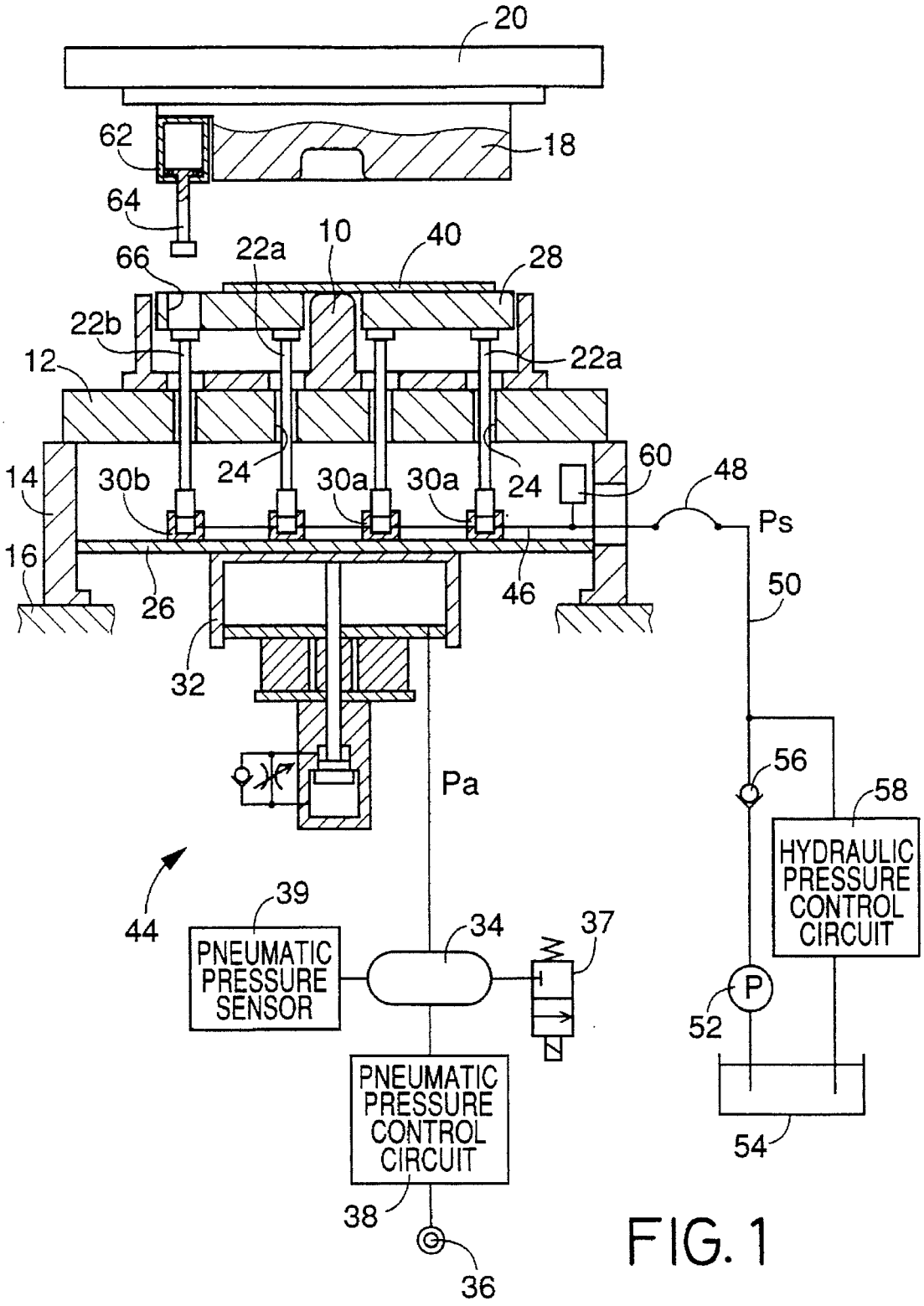
FIG. 1 is a schematic view illustrating a pressing system constructed according to one embodiment of this invention.

Referring first to FIG. 1, there is shown a press having a base 16, a press carrier 14 mounted on the base 16, and a bolster 12 disposed on the press carrier 14 such that the bolster 12 extends in a substantially horizontal direction. A punch 10 is attached to the bolster 12, while a die 18 is carried by a slide plate 20 which is vertically reciprocated by a suitable drive mechanism. The bolster 12 has a multiplicity of through-holes 24 formed through its thickness in a suitable matrix pattern, so that cushion pins **22*a*, 22*b* extend through the through-holes 24**, respectively. Below the bolster 12, there is disposed a cushion platen 26 supporting the cushion pins 22*a*, 22*b*, such that the cushion platen 26 has a substantially horizontal attitude. The cushion pins 22*a* are provided to support at their upper ends a pressure ring 28 which is disposed adjacent to the punch 10. The positions and the number of the cushion pins 22*a* are suitably determined depending upon the size and shape of the pressure ring 28. The punch 10 includes a base portion having a plurality of through-holes corresponding to the cushion pins 22*a*, 22*b* installed.

The cushion platen 26 is provided with a multiplicity of fluid-actuated cylinders in the form of hydraulic cylinders 30 corresponding to the multiple through-holes 24. The hydraulic cylinders consist of cylinders 30*a* and cylinders 30*b*, and have respective pistons and respective piston rods. The cushion pins 22*a* are installed such that the lower end faces are held in abutting contact with the upper end faces of the piston rods of the respective cylinders 30*a*. Similarly, the cushion pins 22*b* are installed such that the lower end faces are held in abutting contact with the upper end faces of the piston rods of the respective cylinders 30*b*. The cylinders 30*a* serve as first cylinders for supporting the pressure ring 28 through the cushion pins 22*a*. The cylinders 30*b* serve as second cylinders for lowering the cushion platen 26 while holding the cushion platen 26 in the substantially horizontal attitude when a load is applied to the second cylinders 30*b* only during a downward movement of the die 18, as described below in detail. The second cylinders 30*b* are at least three cylinders (e.g., four cylinders) which are suitably selected from the hydraulic cylinders 30 other than the first cylinders 30*a*. The second cylinders 30*b* are located at respective portions of the cushion platen 26 which correspond to relatively outer or peripheral portions of the pressure ring 28.

The cushion platen 26 is disposed within the press carrier 14 indicated above, such that the cushion platen 26 is movable in the vertical direction and biased upwards by resistance applying means in the form of a cushioning pneumatic cylinder 32. The pressure chamber of the pneumatic cylinder 32 communicates with an air tank 34 to which compressed air is supplied from a pneumatic pressure source 36 through a pneumatic pressure control circuit 38. To the air tank 34, there are connected a shut-off valve 37 and a pneumatic pressure sensor 39. Pneumatic pressure Pa in the air tank 34 and the pneumatic cylinder 32 is regulated by the pneumatic pressure control circuit 38 and the shut-off valve 37, depending upon a desired value of a blank holding force acting on the pressure ring 28. Described more specifically, when the die 18 is moved down with the slide plate 20, a blank 40 is gripped at its peripheral portion by and between the die 18 and the pressure ring 28, by the blank holding force based on a biasing force of the cushioning pneumatic cylinder 32, that is, based on the pneumatic pressure Pa in the pneumatic cylinder 32. When the die 18 and the pressure ring 28 are further lowered against the biasing force of the pneumatic cylinder 32, the die 18 and the punch 10 cooperate to perform a drawing operation on the blank 40, so as to draw the blank 40 along the forming surface of the punch 10. The biasing force of the cushioning pneumatic cylinder 32 provides a resistance to the downward movement of the cushion platen 26, whereby the blank holding force is generated.

The multiple hydraulic cylinders 30 have respective pressure chambers communicating with each other through a communicating passage 46 which is connected to a conduit 50 through a flexible tube 48. Each hydraulic cylinder 30 has a piston defining the pressure chamber, and a piston rod integral with the piston. The piston rod has the same diameter as the piston so that no pressure chamber is formed on the upper side of the piston. The conduit 50 is connected to a pneumatically driven hydraulic pump 52, which is adapted to pressurize an oil pumped up from an oil reservoir 54, so that the pressurized oil delivered by the pump 52 as the working fluid is supplied to the pressure chambers of the hydraulic cylinders 30 through a check valve 56 provided in the conduit 50. To the conduit 50, there is connected a hydraulic pressure control circuit 58 which incorporates a pressure relief valve. The hydraulic pump 52 and the hydraulic pressure control circuit 58 are controlled so that hydraulic pressure Ps in the conduit 50 and the hydraulic cylinders 30 is regulated such that the pistons of all of the first cylinders 30*a* associated with the cushion pins 22*a* installed are held in their neutral positions during the drawing operation performed on the blank 40. Namely, the hydraulic pressure Ps is regulated so that the blank holding force generated based on the pneumatic pressure Pa is evenly distributed to the pressure ring 28 (and the blank 40) through all of the local cushion pins 22*a*. The hydraulic pressure Ps is detected by a hydraulic pressure sensor 60 connected to the communicating passage 46. In the present embodiment, the cushion pins 22*a*, cushion platen 26, hydraulic cylinders 30 and pneumatic cylinder 32 cooperate to constitute a major portion of a cushioning device 44 which is provided with balancing hydraulic cylinders in the form of the first cylinders 30*a* for even distribution of the blank holding force to the pressure ring 28 through all of the cushion pins 22*a* installed.

The die 18 is provided with shock absorbers 62 which are located right above the respective second cylinders 30*b*. These shock absorbers 62 are fixed to the die 18 such that piston rods 64 of the shock absorbers 62 extend in the downward direction toward the pressure ring 28. Each of the shock absorbers 62 includes a cylindrical housing, and a piston which is received within the cylindrical housing and which is formed integrally with the piston rod 64. The cylindrical housing and the piston define two fluid chambers filled with a suitable fluid such as an oil or silicone oil. The piston has at least one orifice communicating with the two fluid chambers. When the piston is moved within the cylindrical housing, the fluid is forced to flow between the fluid chambers through the orifice. The orifice provides a resistance to the flows of the fluid therethrough, which restricts a movement of the piston relative to the cylindrical housing. The piston and the piston rod 64 are normally held in its lower stroke end of FIG. 1, by its own weight or suitable biasing means such as a spring. When the die 18 is lowered with the slide plate 20, the piston rod 64 is brought into abutting contact with the upper end face of the corresponding cushion pin 22*b* before the die 18 collides with the blank 40 and the pressure ring 28. Consequently, the cushion platen 26 is lowered against the biasing force of the cushioning pneumatic cylinder 32, so that the relative speed of the die 18 and the cushion platen 26 (i.e., the speed at which the die 18 collides with the pressure ring 28) is made lower in the present press than in a conventional press not equipped with the shock absorbers 62 and cushion pins 22*b*. Since the pressure ring 28 supported by the cushion platen 26 through the cushion pins 22*a* is lowered with the cushion platen 26, a difference between the speeds of the die 18 and the pressure ring 28 is made smaller in the present press than in the conventional press.

To permit the cushion platen 26 to be lowered by a downward movement of the piston rods 64 of the shock absorbers 62, the pressure ring 28 has through-holes 66 having a diameter larger than that of the piston rods 64, so that the piston rods 64 extend through the through-holes 66 for abutting contact with the upper ends of the cushion pins 22*b*. The through-holes 66 are formed at the peripheral portion of the pressure ring 28, in alignment with the second cylinders 30*b*. However, the second cylinders 30*b* may be located at positions outside the outer circumference of the pressure ring 28. In this case, the pressure ring 28 need not be provided with the through-holes 66. The through-holes 66 may be replaced by cutouts formed through the pressure ring 26 such that the cutouts are open in the outer circumferential surface of the pressure ring 26.

It will be understood that the cushion pins 22*b* serve as link members which are associated at their lower ends with the piston rods of the second cylinders 30*b* and which are abuttable on the piston rods 64 of the shock absorbers 62 when the piston rods 64 are moved down during downward movement of the die 18.

Figure 2:
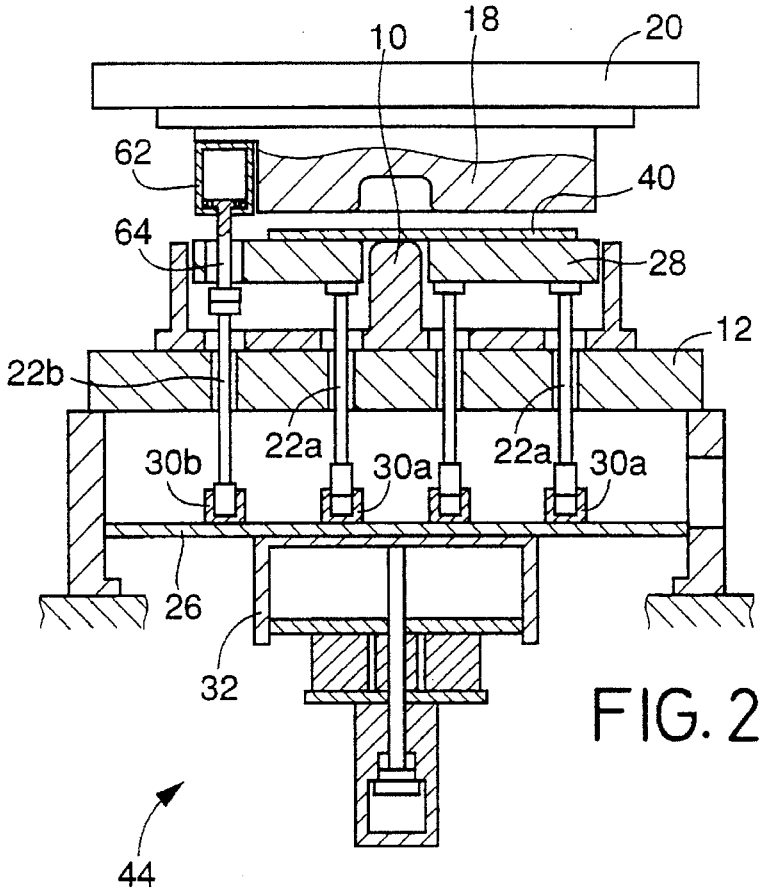
FIG. 2 is a view showing one operating state of the pressing system of FIG. 1, in which pistons of second cylinders are moved to their lower stroke ends by shock absorbers during a downward movement of a die and before the die is brought into abutting contact with a blank on a pressure ring.

The orifices formed through the pistons of the shock absorbers 62 provide a comparatively large resistance to the movements of the piston rods 64, and therefore the shock absorbers 62 generate a comparatively large reaction force upon abutting contact of the piston rods 64 with the cushion pins 22*b*. Accordingly, the pistons of the second cylinders 30*b* are held at their lower stroke ends (held bottomed) almost throughout an drawing operation on the blank 40, which is initiated with collision of the die 18 with the blank 40. Described in detail, the pistons of the second cylinders 30*b* are kept lowered (without upward movements thereof) with the downward movements of the cushion pins 22*b* together with the piston rods 64 after the abutting contact of the rods 64 with the cushion pins 22*b* during a downward movement of the die 18 with the slide plate 20. FIG. 2 shows the pistons of the second cylinders 30*b* placed at their lower stroke ends. As the pistons of the second cylinders 30*b* are lowered, the fluid in the pressure chambers of the second cylinders 30*b* is pressurized and is consequently discharged into the pressure chambers of the first cylinders 30*a* in which the pressurization of the fluid has not been initiated. The fluid flows from the second cylinders 30*b* contribute to reduction of shocks or impacts upon abutting contact of the piston rods 64 with the cushion pins 22*b* and upon bottoming of the pistons of the second cylinders 30*b*, thereby preventing generation of a considerable noise and reducing a shock to be given to the cushion platen 26.

With a further downward movement of the die 18, the piston rods 64 of the shock absorbers 62 are moved upwards with the pistons, and the cushion platen 26 is lowered against the biasing force of the pneumatic cylinder 32, by a reaction force generated by the shock absorbers 64 during the upward movement of the piston rods 64. Accordingly, the pressure ring 28 is lowered with the cushion platen 26. After the downward movement of the cushion platen 26 is initiated, the die 18 is brought into abutting contact with the blank 40 and the pressure ring 28. Since the downward movement of the pressure ring 28 with the cushion platen 26 has already been initiated, the speed at which the die 18 collides with the pressure ring 28 is reduced by an amount corresponding to the speed of the downward movement of the pressure ring 28 when the collision takes place. Accordingly, the shock produced by the collision of the die 18 and the pressure ring 28 (blank 40) is reduced, whereby the collision noise and deterioration of the blank holding performance of the pressure ring 28 are minimized.

Figure 3:
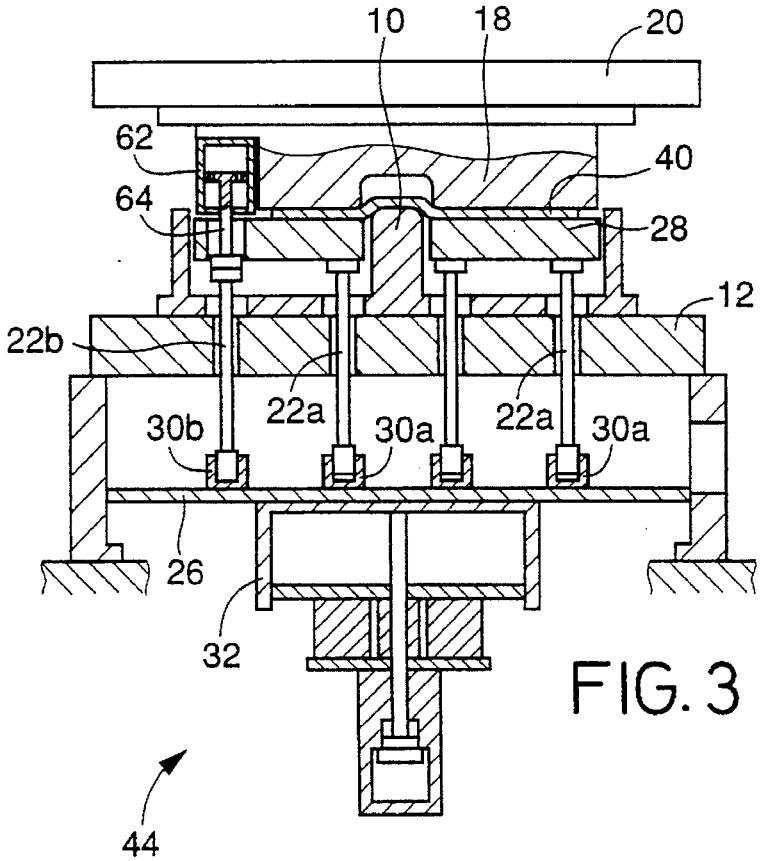
FIG. 3 is a view showing another operating state of the pressing system, in which the die is brought into abutting contact with the blank as a result of a further downward movement of the die from the position of FIG. 2.

When the die 18 comes into abutting contact with the blank 40, the blank 40 is gripped at its peripheral portion by and between the die 18 and the pressure ring 28. With a downward movement of the pressure ring 28 with the die 18, the pistons of the first cylinders 30*a* are moved down to their neutral positions as indicated in FIG. 3. At this point of time, the pistons of the second cylinders 30*b* are still held at their lower stroke ends or bottomed, in this embodiment. In other words, the shock absorbers 62 in the present embodiment are adapted such that the pistons of the second cylinders 30*b* are kept bottomed even after the pistons of the first cylinders 30*a* are moved down to their neutral positions, to thereby inhibit or restrict the upward movement of the cushion platen 26. This arrangement is effective to reduce or minimize vibration or oscillation of the cushion platen 26 after the collision of the die 18 with the pressure ring 28 (via the blank 40), and thereby reduce an undesirable oscillatory change or variation of the blank holding force which is transmitted to the pressure ring 28 from the cushion platen 26 through the cushion pins 22*a*.

Figure 4:
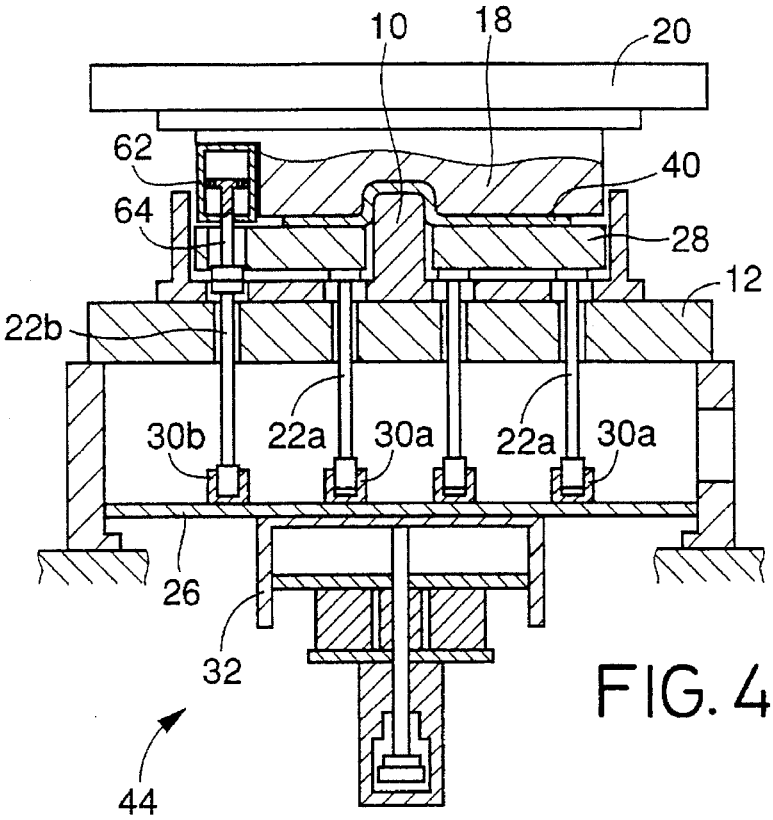
FIG. 4 is a view showing a further operating state of the pressing system, in which the blank has been drawn with a further downward movement of the die from the position of FIG. 3.

With the blank 40 held at its peripheral portion by and between the die 18 and the pressure ring 28 as described above, a drawing operation to draw the blank 40 along the forming surface of the punch 10 is performed during a further downward movement of the die 18, pressure ring 28 and cushion platen 26 as a unit against the biasing force of the pneumatic cylinder 32, as shown in FIG. 4. Described more precisely, however, the present embodiment is adapted so that the drawing operation is initiated when the pistons of the first cylinders 30*a* have been moved to their neutral positions of FIG. 3. Namely, the holding of the blank 40 by and between the die 18 and the pressure ring 28 and the drawing operation on the blank 40 are almost simultaneously initiated in the present embodiment. However, the moment at which the holding of the blank 40 is initiated can be suitably determined by changing the initial position of the pressure ring 28 (prior to the collision of the die 18 with the pressure ring 28). The initial position of the pressure ring 28 may be selected so that the holding of the blank 40 with the desired force is initiated before the initiation of the drawing operation on the blank 40.

As described above, the press according to the present embodiment of the invention is constructed such that the cushion platen 26 and the pressure ring 28 are lowered by the shock absorbers 62 before the die 18 collides with the pressure ring 28 via the blank 40, so that the speed at which the die 18 collides with the pressure ring 28 is made lower in the present press than in the conventional press not equipped with the shock absorbers 62, whereby the collision shock and noise and the deterioration of the blank holding performance of the pressure ring 28 are significantly reduced. Since the cushion pins 22*b* with which the piston rods 64 of the shock absorbers 62 come into abutting contact are supported at their lower ends by the second cylinders 30*b* communicating with the first cylinders 30*a*, the shock generated upon abutting contact of the piston rods 64 with the cushion pins 22*b* and the shock generated upon bottoming of the pistons of the second cylinders 30*b* are comparatively small, whereby the generation of a considerable noise during the drawing operation is avoided, and the shock given to the cushion platen 26 is considerably reduced. Accordingly, the cushion platen 26 is protected against its deflection or bending deformation. Further, the blank holding force is evenly or uniformly distributed to the pressure ring 28 through all of the cushion pins 22*a* installed, in the presence of the first cylinders 30*a* which are disposed on the cushion platen 26 and whose pistons are placed in their neutral positions when the blank 40 is held by and between the die 18 and the pressure ring 28. Thus, the first cylinders 30*a* assure the desired distribution of the blank holding force through the cushion pins 22*a*.

Further, the biasing force of the cushioning pneumatic cylinder 32 is transmitted to the shock absorbers 62 and the die 18 through the cushion platen 26, second cylinders **30*b* and cushion pins 22*b*, when the piston rods 64 of the shock absorbers 62 are brought into contact with the cushion pins 22*b*. At this point of time, the gear backlash of the drive mechanism for reciprocating the slide plate 20 and plays of the various mechanical components of the press have been eliminated. That is, the gear backlash and the mechanical plays have been eliminated before the die 18 collides with the pressure ring 28, whereby the blank 40 is smoothly gripped by and between the die 18 and the pressure ring 28, without an oscillatory change of the blank holding force even during an initial period of the drawing operation. This elimination of the gear backlash and mechanical plays and the reduced collision speed of the die 18 and the pressure ring 28** provide a synergistic effect to assure suitable holding of the blank without the oscillatory change of the blank holding force during the initial period of the drawing operation.

It is also noted that the vibration of the cushion platen 26 due to the collision of the die 18 and the pressure ring 28 is prevented or minimized since the pistons of the second cylinders **30*b* are held at their lower stroke ends when the pistons of the first cylinders 30*a* are held at their neutral positions. This arrangement is effective to minimize oscillatory variation of the blank holding force transmitted to the pressure ring 28 from the cushion platen 26 through the cushion pins 20*b*. Thus, the blank 40 can be suitably held with high stability so as to assure high quality of the products manufactured by the drawing operation on the blank 40**.

As in the conventional press, the multiple hydraulic cylinders 30 are provided on the cushion platen 26 as balancing hydraulic cylinders for even distribution of the blank holding force. Selected ones of these hydraulic cylinders 30 other than those used as the first cylinders **30*a* (actually used balancing hydraulic cylinders) are used as the second cylinders 30*b*. Therefore, the present press is available at a relatively low cost, by simply attaching the shock absorbers 62 to the die 18 and providing the pressure ring 28 with the through-holes 66** in the conventional press, without a considerable modification.

In the first embodiment described above, the pistons of the second cylinders **30*b* are held at their lower stroke ends or kept bottomed throughout the drawing operation on the blank 40. However, the resistance to the movements of the piston rods 64 of the shock absorbers 62 may be suitable determined so that the pistons of the second cylinders 30*b* are not held at their lower stroke ends throughout the drawing operation, for example, so that the pistons of the second cylinders 30*b* are moved up from their lower stroke ends after they are once bottomed. The movement resistance of the piston rods 64 may be changed by changing the viscosity of the fluid in the shock absorbers 62, and/or suitably determining the diameter or cross sectional area and/or number of the orifices formed in the shock absorbers 62, and/or the pressure receiving area of the pistons of the shock absorbers 62**.

Figure 5:
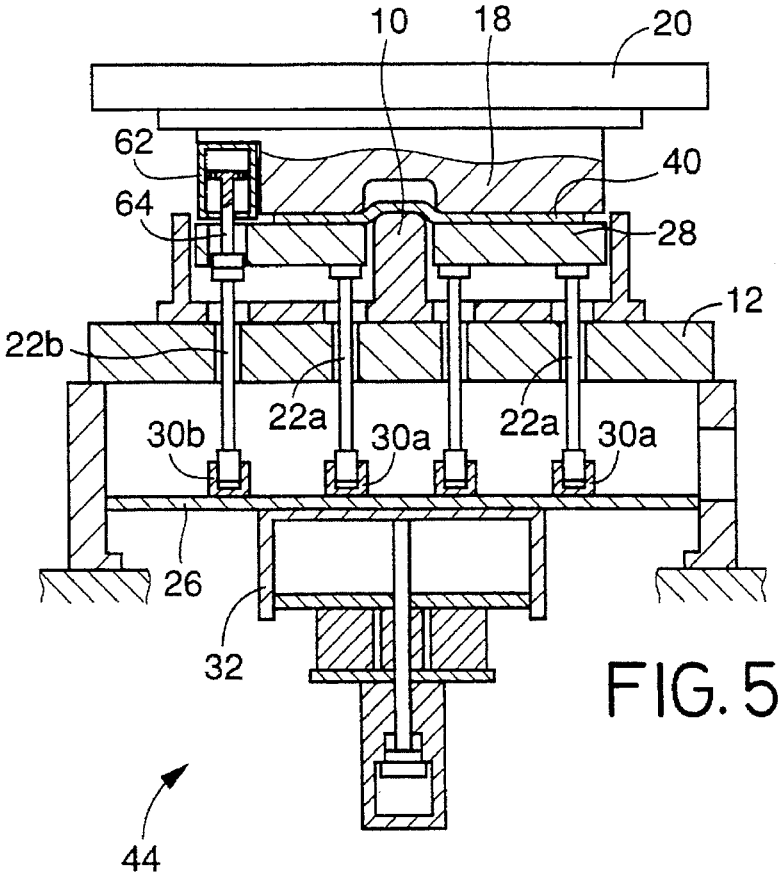
FIG. 5 is a view corresponding to that of FIG. 3, in a pressing system according to another embodiment of the invention, wherein the operating characteristics of the shock absorbers are different from those in the pressing system of FIG. 1 so that the pistons of the second cylinders are moved up from their lower stroke ends by downward movements of the pistons of first cylinders.
Figure 6:
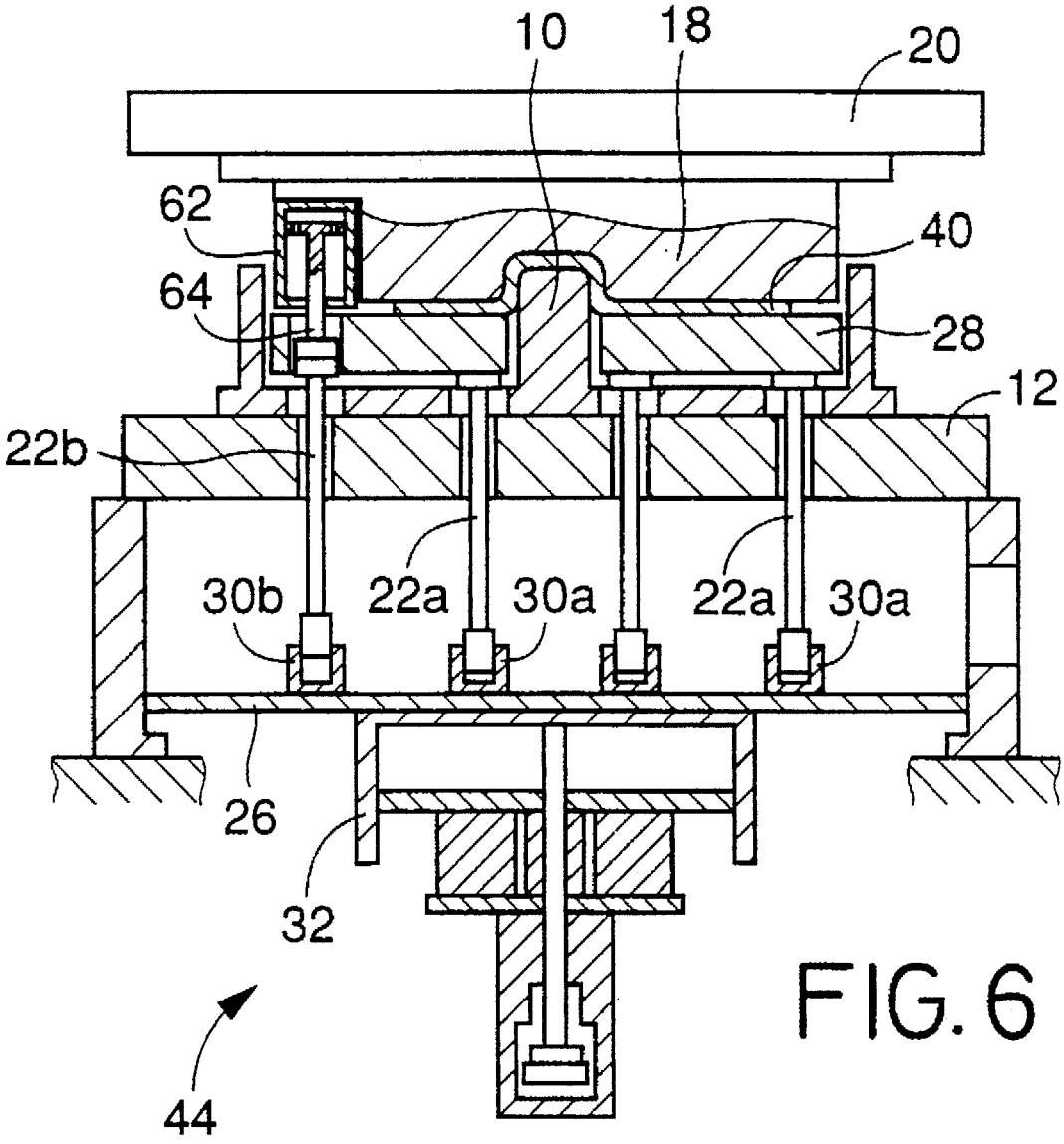
FIG. 6 is a view corresponding to that of FIG. 4, in the embodiment of FIG. 5, showing further upward movements of the pistons of the second cylinders during the drawing operation.

Referring to FIGS. 5 and 6, there will be described a second embodiment of this invention, wherein the shock absorbers 62 are designed so that the pistons of the second cylinders **30*b* are moved up from the lower stroke ends after the pistons have been once moved to the lower stroke ends. FIG. 5 shows an operating state of the press in which the pistons of the second cylinders 30*b* are moved up a given distance from the lower stroke ends after those pistons are once bottomed as indicated in FIG. 2. This upward movement of the pistons of the second cylinders 30*b* is caused by an increase in the pressure Ps in the first cylinders 30*a* as a result of downward movement of the pistons of the first cylinders 30*a* after the collision of the die 18 with the pressure ring 28. FIG. 6 shows another operating state of the press after which the pistons of the second cylinders 30*b* have been further moved up by the pressure Ps during the drawing operation in which the relative speed of the piston rods 64 and the cushion platen 26 is substantially zeroed. The shock absorbers 62 may be adapted so that the pistons of the second cylinders 30*b* are held at their lower stroke ends as shown in FIG. 3 when the pistons of the first cylinders 30*a* are moved to their neutral positions of FIG. 5. In this case, the pistons of the second cylinders 30*b* are subsequently moved up from the lower stroke ends as shown in FIG. 6**.

In the second embodiment of FIGS. 5 and 6 wherein the pistons of the second cylinders **30*b* are moved up from the lower stroke ends during the drawing operation, the volume of the pressure chamber of each second cylinder 30*b* is increased, and the pressure Ps in that pressure chamber is accordingly lowered, whereby the blank holding force transmitted to the pressure ring 28 through the first cylinders 30*a* is lowered. The pressure Ps in the first and second cylinders 30*a*, 30*b* when their pistons are all placed in their neutral positions is determined by the biasing force of the cushioning pneumatic cylinder 32, that is, by the pneumatic pressure Pa in the cylinder 32. Consequently, an increase in the volume of the pressure chambers of the second cylinders 30*b* causes an eventual decrease in the volume of the pressure chambers of the first cylinders 30*a*, so that the pressure Ps is substantially held at a constant level corresponding to the pneumatic pressure Pa. However, a delayed volume decrease of the first cylinders 30*a* with respect to the volume increase of the second cylinders 30*b* will cause temporary expansion of the fluid and consequent drop of the hydraulic pressure Ps, resulting in temporary decrease of the blank holding force. The amount of decrease of the blank holding force varies depending upon the rate and amount of change of the volume of the cylinders 30. Hence, the blank holding force can be reduced as needed during the drawing operation, if the movement resistance or operating characteristic of the shock absorbers 62 is suitably determined by adjusting the diameters of the orifices and/or the viscosity of the fluid in the shock absorbers 62. This arrangement is effective to prevent a risk of cracking or rupture of the blank 40 and to assure improved quality of the products to be manufactured by drawing, or permit the use of a lower-quality material as the blank 40**.

While the present invention has been described above in detail in its presently preferred embodiments, it is to be understood that the invention may be otherwise embodied.

For instance, the shock absorbers 62 which are attached to the die 18 in the illustrated embodiments may be attached to the slide plate 20 or other suitable member which moves with the die 18. Alternatively, the shock absorbers 62 may be disposed for direct connection or association with the piston rods of the second cylinders **30*b*. In this case, the piston rods 64 extend in the upward direction for abutting contact with the die 18 or a member moving with the die 18**.

In the illustrated embodiments, the piston rods 64 of the shock absorbers 62 are abuttable on the piston rods of the second cylinders **30*b* through the cushion pins 22*b* identical with the cushion pins 22*a* for transmitting the blank holding force to the pressure ring 28. However, the cushion pins 22*b* may be replaced by any other members for linking the piston rods 64 with the piston rods of the second cylinders 30*b* during downward movement of the die 18. Alternatively, the piston rods 64 may be replaced by longer rods so that the piston rods are abuttable directly on the piston rods of the second cylinders 30*b*. In this case, the cushion pins 22*b*** are not required.

While the second cylinders **30*b* are identical with the first cylinders 30*a* used as the balancing hydraulic cylinders for even distribution of the blank holding force, it is possible to use, as the second cylinders, hydraulic cylinders which are different from the hydraulic cylinders 30 (30*a***) in the pressure-receiving area and/or operating stroke of the pistons, for example.

Although all of the hydraulic cylinders 30 communicate with each other through the communication passage 46 in the illustrated embodiments, the hydraulic cylinders 30 may consist of two or more groups of hydraulic cylinders which are disposed in respective local areas of the cushion platen 26 such that the cylinders in each group communicate with each other and do not communicate with the cylinders in the other groups. In this case, too, at least three second cylinders **30*b* are selected from the two or more more groups of the hydraulic cylinders 30**.

While the illustrated embodiments use the hydraulic cylinders 30 actuated by a working oil, the press may use other fluid-actuated cylinders actuated by other liquids or gels.

The pneumatic cylinder 32 provided as the resistance applying means in the illustrated embodiments may be replaced by other means such as a hydraulic cylinder equipped with a pressure relief function or a suitable spring.

It is to be understood that the invention may be embodied with various other changes, modifications and improvements, which may occur to those skilled in the art, in the light of the foregoing disclosure.

What is claimed is:

1. A method of performing a drawing operation on a blank in a pressing system including (a) a die and a punch cooperating to perform the drawing operation to draw the blank along a forming surface of the punch, a cushion platen, (c) resistance applying means for applying a resistance to a movement of the cushion platen, (d) a pressure ring cooperating with the die to hold the blank at a peripheral portion thereof during the drawing operation, (e) a plurality of first cylinders disposed on said cushion platen and having respective pressure chambers and respective pistons, and (f) a plurality of cushion pins interposed between said first cylinders and said pressure ring, for transmitting a blank holding force based on said resistance to said pressure ring, wherein the drawing operation is performed during movements of said pressure ring and the die relative to the punch in a pressing direction against said resistance, such that the pistons of said first cylinders are held at neutral positions between upper and lower stroke ends thereof, for even distribution of said blank holding force to said pressure ring through all of said cushion pins, said method comprising the steps of:

providing said cushion platen with a plurality of second cylinders which have respective pressure chambers communicating with the pressure chambers of said first cylinders;

providing a plurality of shock absorbers between said second cylinders respectively and one of said die and a member moving with said die; and moving down said cushion platen against said resistance, by cooperation of said second cylinders and said shock absorbers during a downward movement of said die toward said pressure ring and before holding of said blank by said blank holding force by and between said die and said pressure ring, for thereby reducing a speed at which said die collides with said pressure ring through said blank.

2. A pressing method according to claim 1, wherein said step of moving down said cushion platen comprises holding pistons of said second cylinders at substantially lower stroke ends thereof at least for a period immediately after pistons of the first cylinders have been moved to neutral positions thereof between upper and stroke ends thereof.

3. A pressing method according to claim 1, wherein said step of moving down said cushion platen comprises permitting pistons of said second cylinders to move toward said pressure ring during said drawing operation while said blank is held by and between said die and said pressure ring.

4. A pressing system including (a) a die and a punch cooperating to perform a drawing operation on a blank to draw the blank along a forming surface of the punch, (b) a cushion platen, (c) resistance applying means for applying a resistance to a movement of the cushion platen, (d) a pressure ring cooperating with the die to hold the blank at a peripheral portion thereof during the drawing operation, (e) a plurality of first cylinders disposed on said cushion platen and having respective pressure chambers and respective pistons, and (f) a plurality of cushion pins interposed between said first cylinders and said pressure ring, for transmitting a blank holding force based on said resistance to said pressure ring, wherein the drawing operation is performed during movements of said pressure ring and the die relative to the punch in a pressing direction against said resistance, such that the pistons of said first cylinders are held at neutral positions between upper and lower stroke ends thereof, for even distribution of said blank holding force to said pressure ring through all of said cushion pins, said pressing system comprising:

a plurality of second cylinders disposed on a cushion platen and having respective pressure chambers communicating with the pressure chambers of said first cylinders;

a plurality of shock absorbers disposed between said second cylinders respectively and one of said die and a member moving said die; and said second cylinders and said shock absorbers cooperating to move down said cushion platen against said resistance during a downward movement of said die toward said pressure ring and before holding of said blank by and between said die and said pressure ring, for thereby reducing a speed at which said die collides with said pressure ring through said blank.

5. A pressing system according to claim 4, wherein each of said first and second cylinders has a piston, and each of said shock absorbers includes a piston rod which is moved with the piston of the corresponding second cylinder during simultaneous operations of said each shock absorber and said corresponding second cylinder, said each shock absorber having a resistance to movement of said piston rod thereof which resistance is determined to hold the piston of said corresponding second cylinder at a substantially lower stroke end thereof at least for a period immediately after the pistons of said first cylinders have been moved to neutral positions thereof between upper and lower stroke ends thereof.

6. A pressing system according to claim 4, wherein each of said first and second cylinders has a piston, and each of said shock absorbers includes a piston rod which is moved with the piston of the corresponding second cylinder during simultaneous operations of said each shock absorber and said corresponding second cylinder, said each shock absorber having a resistance to movement of said piston rod thereof which resistance is determined to permit the piston of said corresponding second cylinder to move toward said pressure ring during said drawing operation while said blank is held by and between said die and said pressure ring.

7. A pressing system according to 4, wherein each of said shock absorbers includes a cylindrical housing and a piston which is received in said cylindrical housing and which has at least one orifice formed therethrough, said cylindrical housing and said piston defining two fluid chambers which are filled with a fluid and which are formed on opposite sides of said piston, said two fluid chambers communicating with each other through said at least one orifice, said at least one orifice providing a predetermined resistance to flows of said fluid therethrough and thereby providing a resistance to movement of said piston relative to said cylindrical housing.

8. A pressing system according to claim 4, wherein said plurality of second cylinders have respective piston rods, and said plurality of shock absorbers are attached to said die and have respective piston rods which are brought into abutting contact with the piston rods of the corresponding second cylinders during the downward movement of said die toward said pressure ring.

9. A pressing system according to claim 4, wherein said second cylinders have respective piston rods, and said pressure ring has a plurality of through-holes which are formed therethrough and which correspond to said plurality of shock absorbers, said shock absorbers having respective piston rods which extend through said through-holes for abutting contact with the piston rods of said second cylinders, respectively, to move down said second cylinders, during said downward movement of said die toward said pressure ring and before holding of said blank by and between said die and said pressure ring.

10. A pressing system according to claim 9, further comprising a plurality of link members which are associated at lower ends thereof with said piston rods of said second cylinders, respectively, said piston rods of said shock absorbers being abuttable on upper ends of said link members to thereby move down said piston rods of said second cylinders.

* * * * *